US009390581B2

(12) United States Patent
Nashida

(10) Patent No.: US 9,390,581 B2
(45) Date of Patent: Jul. 12, 2016

(54) INFORMATION GENERATION DEVICE, INFORMATION PROVISION SYSTEM, AND INFORMATION STORAGE MEDIUM

(71) Applicant: NAMCO BANDAI Games Inc., Tokyo (JP)

(72) Inventor: Hiroyuki Nashida, Yokohama (JP)

(73) Assignee: BANDAI NAMCO Entertainment Inc., Tokyo (JP)

( * ) Notice: Subject to any disclaimer, the term of this patent is extended or adjusted under 35 U.S.C. 154(b) by 397 days.

(21) Appl. No.: 13/837,049

(22) Filed: Mar. 15, 2013

(65) Prior Publication Data

US 2013/0252689 A1 Sep. 26, 2013

(30) Foreign Application Priority Data

Mar. 23, 2012 (JP) ..... 2012-067139
Mar. 23, 2012 (JP) ..... 2012-067140
Mar. 23, 2012 (JP) ..... 2012-067141

(51) Int. Cl.
*G07F 17/32* (2006.01)

(52) U.S. Cl.
CPC ..... *G07F 17/3225* (2013.01); *G07F 17/329* (2013.01)

(58) Field of Classification Search
USPC ..... 463/17, 18, 19, 20
See application file for complete search history.

(56) References Cited

U.S. PATENT DOCUMENTS

2006/0040747 A1 2/2006 Tao et al.
2007/0202946 A1* 8/2007 Matsuyama ..... 463/30
2008/0287175 A1* 11/2008 Kusuda et al. ..... 463/17
2009/0227362 A1* 9/2009 Kelly et al. ..... 463/25

FOREIGN PATENT DOCUMENTS

JP 2001129258 A 5/2001
JP 2002-366852 A 12/2002
JP 2006-059178 A 3/2006
JP 2009-119030 A 6/2009
JP 2010-240222 A 10/2010

OTHER PUBLICATIONS

FAQ for the game "Dragon Collection", Apuri Sutairu, vol. 3, Kabushiki Kaisha East Press, Jul. 1, 2011, p. 22 (with partial English translation).

* cited by examiner

*Primary Examiner* — Paul A D'Agostino
*Assistant Examiner* — Brandon Gray
(74) *Attorney, Agent, or Firm* — Posz Law Group, PLC

(57) ABSTRACT

An information generation device includes an adjustment section that adjusts a selection probability of a game medium that is provided to a second player based on a game status of a first player, the game medium being displayed in a game, and an information generation section that generates indication information corresponding to the selection probability adjusted by the adjustment section, the indication information indicating the selection probability of the game medium in a lottery event to the second player, the lottery event being an event for providing the game medium.

19 Claims, 14 Drawing Sheets

FIG.14

600

CONGRATULATIONS ON 500TH LOTTERY! RARE MONSTER SELECTION PROBABILITY IS TRIPLED FROM 14:00 TO 18:00 TOMORROW

INFORMATION GENERATION DEVICE, INFORMATION PROVISION SYSTEM, AND INFORMATION STORAGE MEDIUM

Japanese Patent Application No. 2012-67139 filed on Mar. 23, 2012, Japanese Patent Application No. 2012-67140 filed on Mar. 23, 2012, and Japanese Patent Application No. 2012-67141 filed on Mar. 23, 2012, are hereby incorporated by reference in their entirety.

BACKGROUND OF THE INVENTION

The present invention relates to an information generation device, an information provision system, and an information storage medium.

JP-A-2001-129258 discloses a network game system (game information distribution system) that sets the selection probability of each card, and provides a card corresponding to the selection probability. JP-A-2001-129258 also discloses that a specific card is provided when a given condition has been satisfied (e.g., when the game has reached a given state).

According to the technique disclosed in JP-A-2001-129258, however, since the selection probability of a rare card or the like in a lottery event is fixed, it is difficult to sufficiently motivate the player to play the game. Moreover, the technique disclosed in JP-A-2001-129258 has a problem in that it is difficult to provide the game with strategic characteristics (e.g., it is difficult for the player to strategically acquire a rare card or the like). According to the technique disclosed in JP-A-2001-129258, since the player is not notified whether or not the lottery event can be executed, the game medium provision timing may not be appropriate for the player (i.e., the game medium may not be effectively provided to the player).

SUMMARY

The invention may provide an information generation device, an information provision system, and an information storage medium that can generate information for more effectively providing a game medium.

According to a first aspect of the invention, there is provided an information generation device including:

an adjustment section that adjusts a selection probability of a game medium provided to a second player based on a game status of a first player, the game medium being displayed in a game; and an information generation section that generates indication information corresponding to the selection probability adjusted by the adjustment section, the indication information indicating the selection probability of the game medium in a lottery event to the second player, the lottery event being an event for providing the game medium.

According to a second aspect of the invention, there is provided an information provision system including:

the information generation device; and a terminal that executes the game.

According to a third aspect of the invention, there is provided an information provision system that provides indication information that indicates a selection probability of a game medium in a lottery event for providing the game medium, the game medium being displayed in a game, the information provision system including:

an adjustment section that adjusts a selection probability of a game medium provided to a second player based on a game status of a first player, the game medium being displayed in a game; and an information generation section that generates indication information corresponding to the selection probability adjusted by the adjustment section, the indication information indicating the selection probability of the game medium in a lottery event to the second player, the lottery event being an event for providing the game medium.

According to a fourth aspect of the invention, there is provided a non-transitory information storage medium storing a program that causes a computer to function as:

an adjustment section that adjusts a selection probability of a game medium provided to a second player based on a game status of a first player, the game medium being displayed in a game; and an information generation section that generates indication information corresponding to the selection probability adjusted by the adjustment section, the indication information indicating the selection probability of the game medium in a lottery event to the second player, the lottery event being an event for providing the game medium.

BRIEF DESCRIPTION OF THE SEVERAL VIEWS OF THE DRAWING

FIG. 14 is a diagram illustrating an example of an e-mail image according to the third embodiment.

DETAILED DESCRIPTION OF THE EMBODIMENT

Figure 1:
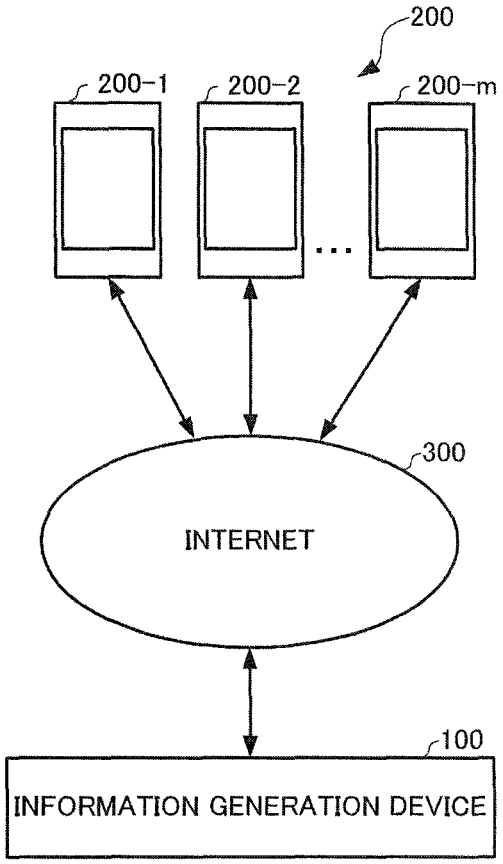
FIG. 1 is a diagram illustrating an information provision system according to a first embodiment of the invention.

According to one embodiment of the invention, there is provided an information generation device including:

an adjustment section that adjusts a selection probability of a game medium provided to a second player based on a game status of a first player, the game medium being displayed in a game; and an information generation section that generates indication information corresponding to the selection probability adjusted by the adjustment section, the indication information indicating the selection probability of the game medium in a lottery event to the second player, the lottery event being an event for providing the game medium.

According to one embodiment of the invention, there is provided an information provision system that provides indication information that indicates a selection probability of a game medium in a lottery event for providing the game medium, the game medium being displayed in a game, the information provision system including:

an adjustment section that adjusts a selection probability of a game medium provided to a second player based on a game status of a first player, the game medium being displayed in a game; and an information generation section that generates indication information corresponding to the selection probability adjusted by the adjustment section, the indication information indicating the selection probability of the game medium in a lottery event to the second player, the lottery event being an event for providing the game medium.

According to one embodiment of the invention, there is provided a non-transitory information storage medium storing a program that causes a computer to function as:

an adjustment section that adjusts a selection probability of a game medium that is provided to a second player based on a game status of a first player, the game medium being displayed in a game; and an information generation section that generates indication information corresponding to the selection probability adjusted by the adjustment section, the indication information indicating the selection probability of the game medium in a lottery event to the second player, the lottery event being an event for providing the game medium.

The information generation device and the like can generate information for more effectively providing the game medium by generating the information that indicates the selection probability of the game medium.

The adjustment section may adjust the selection probability of the game medium provided to the second player based on at least one condition among a condition whereby the first player is playing the game, a condition whereby the first player is participating in a network of the game, a condition whereby a history of the game played by the first player satisfies a given condition, and a condition whereby a history of the lottery event played by the first player satisfies a given condition.

According to the above configuration, the first player and the second player can be linked in an improved way by adjusting the selection probability of the game medium for the second player based on the game status of the first player.

The adjustment section may adjust the selection probability of the game medium provided to the second player on condition that the first player and the second player have a given relationship.

According to the above configuration, the selection probability can be adjusted corresponding to the relationship between the players.

The adjustment section may adjust the selection probability of the game medium provided to the second player on condition that the first player and the second player have a given positional relationship.

According to the above configuration, the selection probability can be adjusted corresponding to the positional relationship between the players.

The number of the first players may be two or more, and the adjustment section may increase the selection probability of the game medium provided to the second player as the number of the first players who satisfy a selection probability adjustment condition increases.

It is possible to prompt the second player to increase the number of first players by increasing the selection probability of the game medium provided to the second player as the number of first players increases.

The adjustment section may adjust the selection probability of the game medium provided to the second player corresponding to an attribute of the first player who satisfies a selection probability adjustment condition.

This makes it possible to increase the selection probability corresponding to the attribute of the first player.

The information generation device may further include a communication section that transmits the indication information to a terminal that executes the game.

It is possible to generate information for more effectively providing the game medium by thus transmitting the indication information to the terminal.

The communication section may transmit the image information to the terminal when the terminal has connected to a game network, or when the lottery event can be executed, or when the lottery event has been executed in the terminal.

It is possible to allow the player to easily determine the timing to play the lottery by thus transmitting the indication information to the terminal before executing the lottery.

According to one embodiment of the invention, there is provided an information provision system that includes:

the information generation device; and the terminal.

It is possible to generate information for more effectively providing the game medium by thus transmitting the indication information to the terminal.

The terminal may include an image generation section and a display section, the information generation section may generate an e-mail as the indication information, the image generation section may generate an image that indicates the selection probability based on the e-mail transmitted from the information generation device, and the display section may display the image.

It is possible to allow the player to easily determine the timing to play the lottery by thus displaying the image of the e-mail that indicates the selection probability on the terminal.

The terminal may include an image generation section and a display section, the information generation section may generate image information as the indication information, the image generation section may generate an image that indicates the selection probability based on the image information transmitted from the information generation device, and the display section may display the image.

It is possible to generate information for more effectively providing the game medium by thus displaying the image that indicates the selection probability on the terminal.

According to one embodiment of the invention, there is provided an information generation device including:

a determination section that determines whether or not a lottery event for providing a game medium can be executed based on an execution parameter value for executing the lottery event; and an information generation section that generates information that indicates that the lottery event can be executed when the determination section has determined that the lottery event can be executed.

According to one embodiment of the invention, there is provided an information provision system that provides information that indicates that a lottery event for providing a game medium can be executed, the information provision system including:

a determination section that determines whether or not the lottery event can be executed based on an execution parameter value for executing the lottery event; and an information generation section that generates information that indicates that the lottery event can be executed when the determination section has determined that the lottery event can be executed.

According to one embodiment of the invention, there is provided a non-transitory information storage medium storing a program that causes a computer to function as:

a determination section that determines whether or not a lottery event for providing a game medium can be executed based on an execution parameter value for executing the lottery event; and an information generation section that generates information that indicates that the lottery event can be executed when the determination section has determined that the lottery event can be executed.

The information generation device and the like can generate information for more effectively providing the game medium by generating the information that indicates that the lottery event can be executed.

According to one embodiment of the invention, there is provided an information generation device including:

a determination section that determines whether or not a lottery event for providing a game medium that is displayed in a game can be executed based on an execution parameter value for executing the lottery event;

an adjustment section that adjusts a selection probability of the game medium based on a variable element parameter value that changes the selection probability of the game medium in the lottery event; and an information generation section that generates indication information corresponding to the selection probability adjusted by the adjustment section when the determination section has determined that the lottery event can be executed, the indication information indicating the selection probability of the game medium in the lottery event.

According to one embodiment of the invention, there is provided an information provision system that provides indication information that indicates a selection probability of a game medium in a lottery event for providing the game medium, the game medium being displayed in a game, the information provision system including:

a determination section that determines whether or not the lottery event can be executed based on an execution parameter value for executing the lottery event;

an adjustment section that adjusts the selection probability of the game medium based on a variable element parameter value that changes the selection probability of the game medium in the lottery event; and an information generation section that generates the indication information corresponding to the selection probability adjusted by the adjustment section when the determination section has determined that the lottery event can be executed.

According to one embodiment of the invention, there is provided a non-transitory information storage medium storing a program that causes a computer to function as:

a determination section that determines whether or not a lottery event for providing a game medium that is displayed in a game can be executed based on an execution parameter value for executing the lottery event;

an adjustment section that adjusts a selection probability of the game medium based on a variable element parameter value that changes the selection probability of the game medium in the lottery event; and an information generation section that generates indication information corresponding to the selection probability adjusted by the adjustment section when the determination section has determined that the lottery event can be executed, the indication information indicating the selection probability of the game medium in the lottery event.

The information generation device and the like can adjust the selection probability of the game medium based on the variable element parameter value, and can generate information for more effectively providing the game medium by generating indication information that indicates the adjusted selection probability of the game medium.

The adjustment section may adjust the selection probability of the game medium based on a parameter value that relates to a character in the game or a parameter value that relates to a player that is the variable element parameter value.

The variable element parameter value can be changed corresponding to the game status of the player and the like, and the selection probability can be changed by thus adjusting the selection probability of the game medium based on the parameter value that relates to the character in the game or the parameter value that relates to the player.

The information generation device or the like may further include a storage section that stores a plurality of types of game medium data that indicates the selection probability of the game medium, and the adjustment section may adjust the selection probability of the game medium by changing the game medium data to be used.

According to the above configuration, the selection probability of the game medium can be adjusted more quickly since the amount of calculation process and the like can be reduced.

The execution parameter value may be a parameter value that relates to a character in the game or a parameter value that relates to a player.

The execution parameter value can be changed corresponding to the game status of the player and the like, and whether or not to allow execution of the lottery event can be changed by thus adjusting the selection probability of the game medium based on the parameter value that relates to the character in the game or the parameter value that relates to the player.

The parameter value that relates to the player may be at least one of an ability value of an operation target of the player, a attribute value of the operation target, a game result value of the operation target, and a number of times that the lottery event can be played by the player.

The variable element parameter value can be changed corresponding to the game status of the player and the like, and the selection probability can be changed by thus adjusting the selection probability of the game medium based on the ability value of the operation target of the player, and the like.

The information generation device or the like may further include a communication section that transmits the indication information to a terminal that executes the game.

It is possible to provide indication information for more effectively providing the game medium by thus transmitting the indication information to the terminal.

According to one embodiment of the invention, there is provided an information provision system including:

the information generation device; and the terminal.

It is possible to generate information for more effectively providing the game medium by thus transmitting the indication information to the terminal.

The terminal may include an image generation section and a display section, the information generation section may generate image information as the indication information, the image generation section may generate an image that indicates the selection probability based on the image information transmitted from the information generation device, and the display section may display the image.

It is possible to generate information for more effectively providing the game medium by thus displaying the image that indicates the selection probability on the terminal.

According to one embodiment of the invention, there is provided an information provision system including:

an adjustment section that adjusts a selection probability of a game medium that is displayed in a game based on an execution state of a lottery event for providing the game medium; and an information generation section that generates indication information corresponding to the selection probability adjusted by the adjustment section, the indication information indicating the selection probability of the game medium in the lottery event.

According to one embodiment of the invention, there is provided an information provision system that provides indication information that indicates a selection probability of a game medium in a lottery event for providing the game medium, the game medium being displayed in a game, the information provision system including:

an adjustment section that adjusts the selection probability based on an execution state of the lottery event; and an information generation section that generates the indication information corresponding to the selection probability adjusted by the adjustment section.

According to one embodiment of the invention, there is provided a non-transitory information storage medium storing a program that causes a computer to function as:

an adjustment section that adjusts a selection probability of a game medium that is displayed in a game based on an execution state of a lottery event for providing the game medium; and an information generation section that generates indication information corresponding to the selection probability adjusted by the adjustment section, the indication information indicating the selection probability of the game medium in the lottery event.

It is possible to generate information for more effectively providing the game medium by thus generating the information that indicates the selection probability of the game medium.

The execution state of the lottery event may be at least one of the number of times that the lottery event has been executed, an order in which the lottery event has been executed, a date/time at which the lottery event has been executed, and a provision history of the game medium upon execution of the lottery event.

It is possible to prompt the player to play the lottery event by thus adjusting the selection probability corresponding to the number of times that the lottery event has been executed.

The execution state of the lottery event may be a provision history of the game medium upon execution of the lottery event, the adjustment section may increase the selection probability of the game medium that has not been provided as compared with the selection probability of the game medium that has been provided, or may increase the selection probability of the game medium that has been provided with a lower probability or in a smaller number as compared with another game medium, and the information generation section may generate the indication information that indicates that the selection probability of the game medium for which the selection probability has been raised.

It is possible to prompt the player to play the lottery event by thus generating the indication information that indicates that the selection probability of the game medium that has been provided has been raised.

The adjustment section may maintain the selection probability of the game medium until the lottery event has been executed in a given number of times, or a given time has elapsed, after the adjustment section has adjusted the selection probability, and may return the selection probability to a value before the adjustment section has adjusted the selection probability when the lottery event has been executed in a given number of times, or a given time has elapsed.

It is possible to make a moderate adjustment by thus returning the selection probability to a value before the adjustment.

The information generation device may further include a communication section that transmits the indication information to a terminal that executes the game.

It is possible to generate information for more effectively providing the game medium by thus transmitting the indication information to the terminal.

According to one embodiment of the invention, there is provided an information provision system including:

the information generation device; and the terminal.

It is possible to generate information for more effectively providing the game medium by thus transmitting the indication information to the terminal.

The terminal may include an image generation section and a display section, the information generation section may generate image information as the indication information, the image generation section may generate an image that indicates the selection probability based on the image information transmitted from the information generation device, and the display section may display the image.

It is possible to generate information for more effectively providing the game medium by thus displaying the image that indicates the selection probability on the terminal.

The communication section may transmit the image information to the terminal when the terminal has connected to a game network, or when the lottery event can be executed, or when the lottery event has been executed in the terminal.

It is possible to allow the player to easily determine the timing to play the lottery by thus transmitting the indication information to the terminal before executing the lottery.

The terminal may include an image generation section and a display section, the information generation section may generate an e-mail as the indication information, the image generation section may generate an image that indicates the selection probability based on the e-mail transmitted from the information generation device, and the display section may display the image.

It is possible to allow the player to easily determine the timing to play the lottery by thus displaying the image of the e-mail that indicates the selection probability on the terminal.

Exemplary embodiments in which the invention is applied to an information generation device and the like are described below with reference to the drawings. Note that the following embodiments do not unduly limit the scope of the invention as stated in the claims. Note also that all of the elements described below should not necessarily be taken as essential elements of the invention.

First Embodiment

FIG. 1 is a diagram illustrating an information provision system according to a first embodiment of the invention. The information provision system according to the first embodiment includes an information generation device 100 and a smartphone 200. The information provision system is configured so that m smartphones 200 exchange information with the information generation device 100 via an Internet 300. The information generation device 100 transmits game image information based on operation information from the smartphone 200 to the smartphone 200, and the smartphone 200 displays a game image based on the image information.

More specifically, a lottery event is executed in the game when the strength value (i.e., a parameter value for executing a card lottery event) of a character operated by the player is 50% or more, and a game card (game medium) is displayed based on the lottery event as part of a game image, and is assigned to the character.

In the first embodiment, a rare card selection probability increases as the player's winning percentage increases when the player's winning percentage (i.e., a variable element parameter value that changes the card selection probability in the lottery event) in the game is 60% or more. Note that the rare card is a card for which the selection probability in the lottery event is lower than that for a normal card. For example, the rare card is a card for which the selection probability is higher than 0% and lower than 50%.

In the first embodiment, the smartphone 200 displays an image that indicates the selection probability when the lottery event can be executed. The functional blocks of the information generation device 100 having the above functions are described below.

Figure 2:
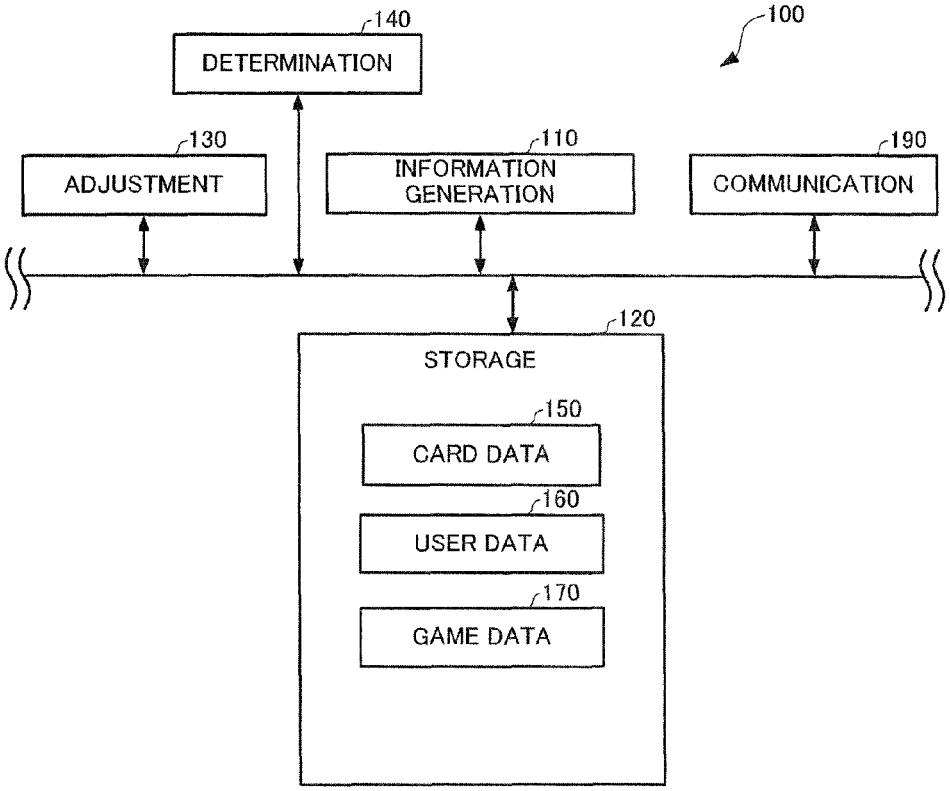
FIG. 2 is a diagram illustrating the functional blocks of an information generation device according to the first embodiment.

FIG. 2 is a diagram illustrating the functional blocks of the information generation device 100 according to the first embodiment. The information generation device 100 includes an information generation section 110 that generates image information and the like, a storage section 120, an adjustment section 130 that adjusts the selection probability, a determination section 140, and a communication section 190 that exchanges information with the smartphone 200.

Note that the image information may be an image (e.g., still image or moving image) itself, or may be image information subjected to compression, division (e.g., packetization), encoding, or the like, or may be identification information about the image data, for example. The communication section 190 may transmit the image information and the like directly to the smartphone 200, or may transmit the image information and the like indirectly to the smartphone 200 through another communication device.

The storage section 120 stores card data 150 that indicates the default selection probability of each card and the like, user data 160 that indicates the strength value of the character of each player, the winning percentage of each player, and the like, and game data 170 for executing the game, and the like.

The information generation device 100 is implemented by a plurality of servers (e.g., application server, web server, search server, and database server). Note that the information generation device 100 may be implemented by a single server when the scale of the information provision system is small. The information generation device 100 may be configured using the following hardware. The information generation section 110, the adjustment section 130, and the determination section 140 may be implemented by a CPU or the like, the storage section 120 may be implemented by a hard disk or the like, and the communication section 190 may be implemented by a LAN card or the like.

The information generation device 100 may read a program from an information storage medium either directly or indirectly (e.g., via a network) to implement the functions of the information generation section 110 and the like. For example, a single server that includes the storage section 120 and controls the communication section 190 may read a program to implement the functions of the information generation section 110 and the like.

Figure 3:
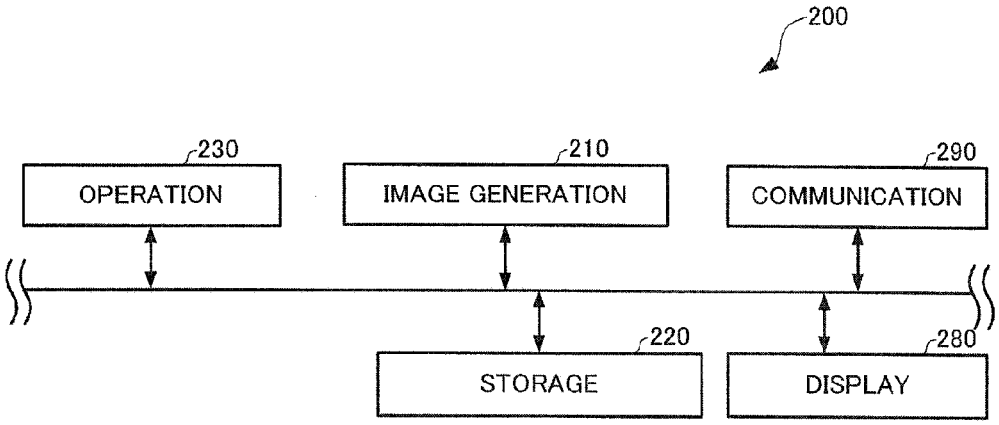
FIG. 3 is a diagram illustrating the functional blocks of a smartphone according to the first embodiment.

The functional blocks of the smartphone 200 are described below. FIG. 3 is a diagram illustrating the functional blocks of the smartphone 200 according to the first embodiment. The smartphone 200 includes an image generation section 210 that generates an image based on the image information and the like transmitted from the information generation device 100, a storage section 220 that stores the image information and the like transmitted from the information generation device 100, an operation section 230 that allows the player to input an operation, and a communication section 290 that exchanges information with the information generation device 100.

The smartphone 200 may be configured using the following hardware. For example, the image generation section 210 may be implemented by an image processing circuit or the like, the storage section 220 may be implemented by a RAM or the like, the operation section 230 and the display section 280 may be implemented by a touch panel or the like, and the communication section 290 may be implemented by a wireless communication unit or the like.

Figure 4:
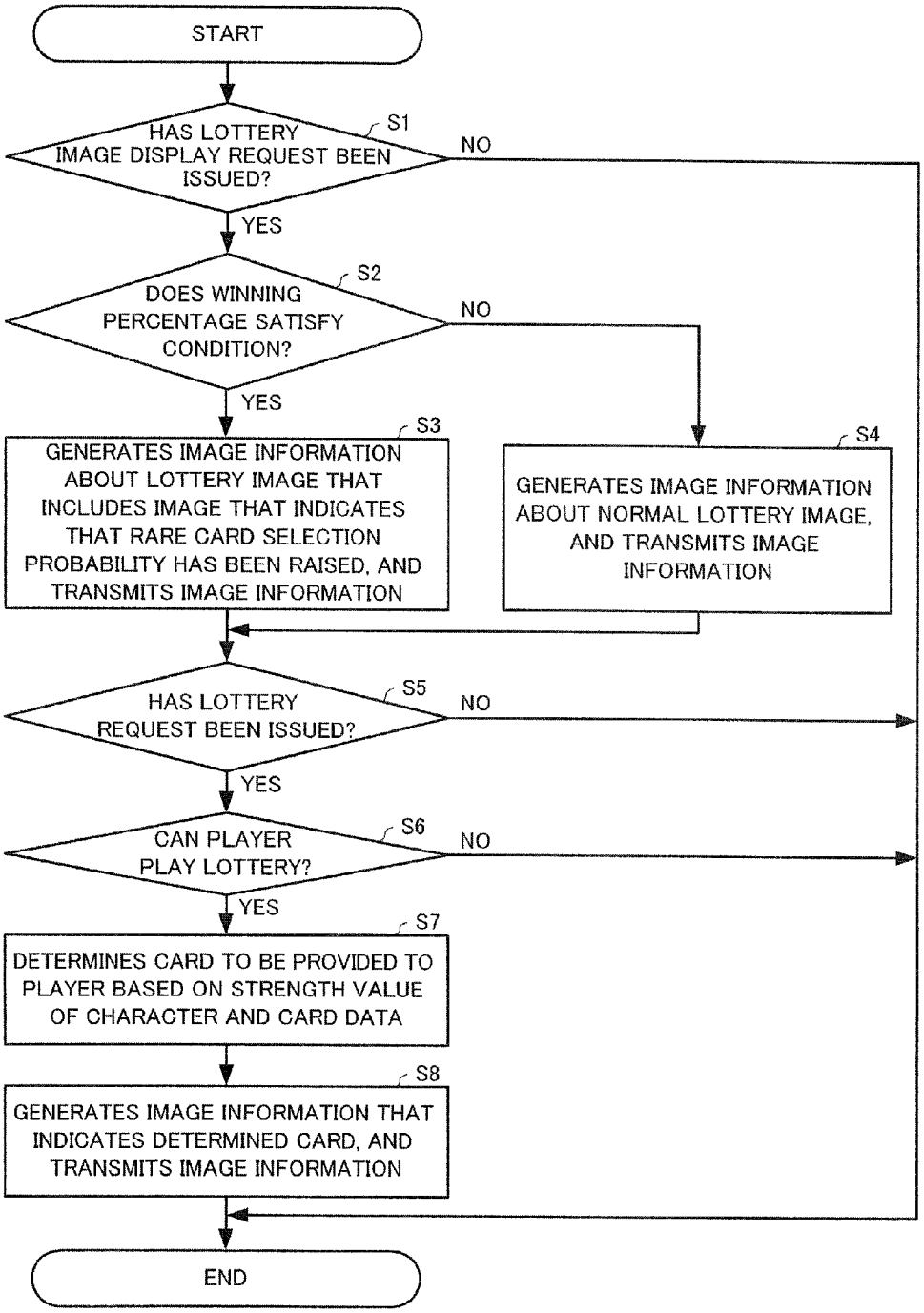
FIG. 4 is a flowchart illustrating a process performed by the information generation device according to the first embodiment.

A process that provides the image information that indicates the rare card selection probability is described below. FIG. 4 is a flowchart illustrating the process performed by the information generation device according to the first embodiment. For example, the player who operates the smartphone 200-1 issues a lottery image display request by operating the operation section 230. The communication section 290 transmits operation information that indicates the lottery image display request to the information generation device 100. The determination section 140 determines whether or not the communication section 190 has received the operation information to determine whether or not the lottery image display request has been issued (step S1).

When the determination section 140 has determined that the lottery image display request has been issued, the determination section 140 determines based on the user data 160 whether or not the battle winning percentage of the player who has issued the lottery image display request in the game satisfies a condition (e.g., 60% or more) whereby the selection probability is raised (step S2).

When the determination section 140 has determined that the winning percentage satisfies the above condition, the information generation section 110 generates image information about a lottery image that includes an image that indicates that the rare card selection probability has been raised, and the communication section 190 transmits the image information to the smartphone 200-1 (step S3).

When the determination section 140 has determined that the winning percentage does not satisfy the above condition, the information generation section 110 generates image information about a normal lottery image, and the communication section 190 transmits the image information to the smartphone 200-1 (step S4).

The communication section 290 of the smartphone 200-1 receives the image information from the information generation device 100, and stores the image information in the storage section 120. The image generation section 210 generates a lottery image based on the image information, and the display section 280 displays the generated lottery image.

Figure 5:
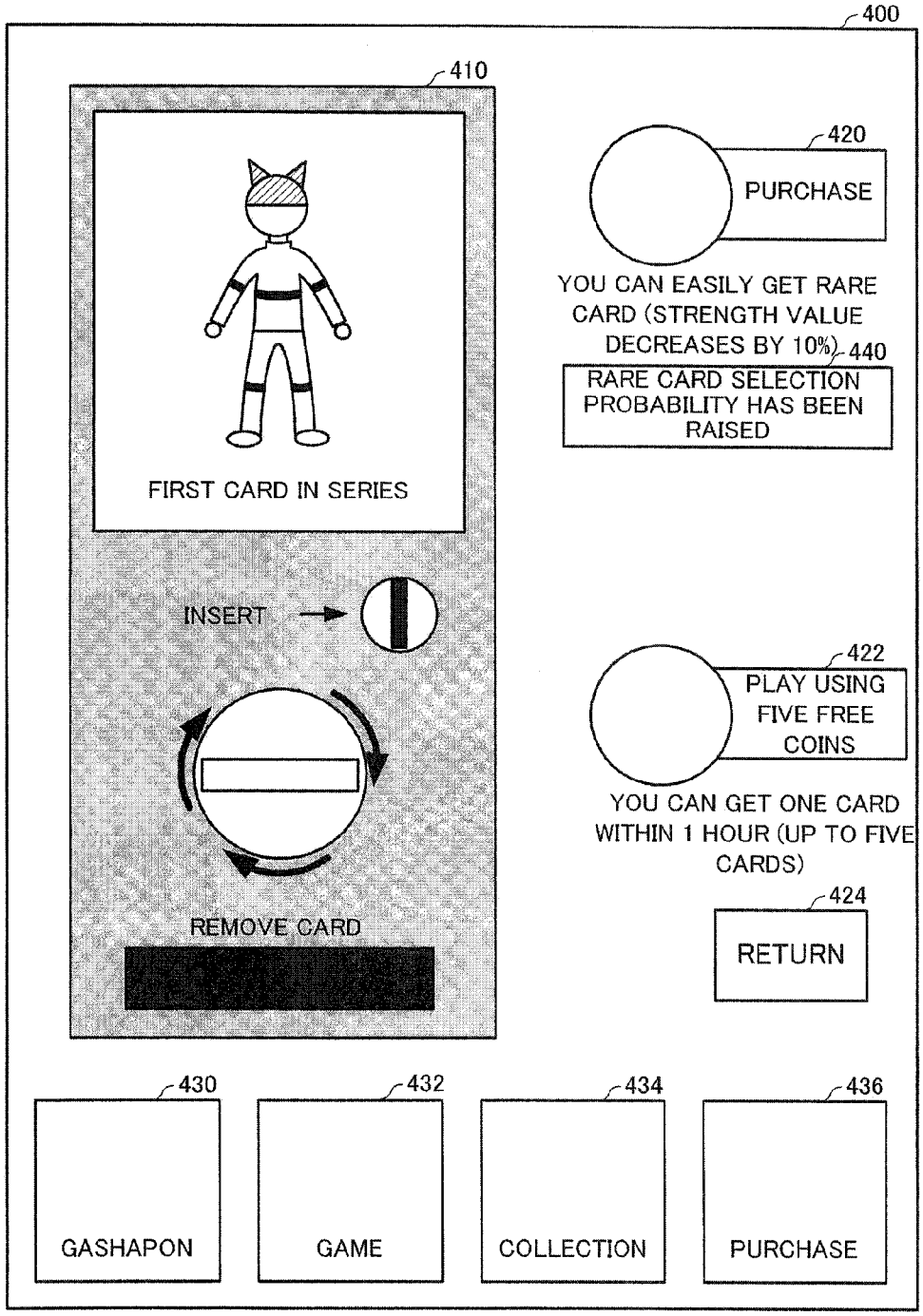
FIG. 5 is a diagram illustrating an example of a lottery image according to the first embodiment.

FIG. 5 is a diagram illustrating an example of a lottery image 400 according to the first embodiment. The lottery image 400 that is generated when the above condition is satisfied includes an indication image 440 that indicates the character string "RARE CARD SELECTION PROBABILITY HAS BEEN RAISED", a system image 410 that simulates a lottery system, a selection image 420 for obtaining a rare card, a selection image 422 for obtaining a normal card, a selection image 424 for returning to the preceding image, a selection image 430 for playing a lottery, a selection image 432 for playing the game, a selection image 434 for viewing the collected cards or the like, a selection image 436 for purchasing an item or the like, and the like. The lottery image 400 that is generated when the above condition is not satisfied does not include the indication image 440.

The player issues a lottery request by selecting the selection image 420. The determination section 140 determines whether or not the communication section 190 has received operation information that indicates the lottery request from the smartphone 200-1 to determine whether or not the lottery request has been issued (step S5). When the determination section 140 has determined that the lottery request has been issued, the determination section 140 determines whether or not the strength value of the character operated by the player is 50% or more (e.g., 50 or more when the maximum strength value is 100) to determine whether or not the player can play a lottery (step S6).

When the determination section 140 has determined that the player can play a lottery, the determination section 140 determines a card to be provided to the player based on the user data 160 that indicates the winning percentage, and the card data 150 determined by the adjustment section 130 (step S7).

For example, when the rare card selection probability is 10% when the winning percentage is less than 60%, is 20% when the winning percentage is 60%, and is 50% when the winning percentage is 100%, the player wins a rare card twice, and wins a normal card eight times when the winning percentage is 60%, and the player plays a lottery ten times, for example. The card data 150 includes a plurality of types of data in which the selection probability of each card is set corresponding to the winning percentage. The adjustment section 130 determines the data to be applied to the player from the plurality of types of data corresponding to the winning percentage. The selection probability of an identical rare card is adjusted by thus changing the data to be applied to the player. Note that the determination section 140 decreases the strength value of the character operated by the player by 10% when the lottery event for providing the card has been executed.

The information generation section 110 generates image information that indicates the card determined by the determination section 140 based on the card data 150, and the communication section 190 transmits the image information to the smartphone 200-1. The display section 280 of the smartphone 200-1 displays an image that indicates the acquired card based on the image information.

Figure 6:
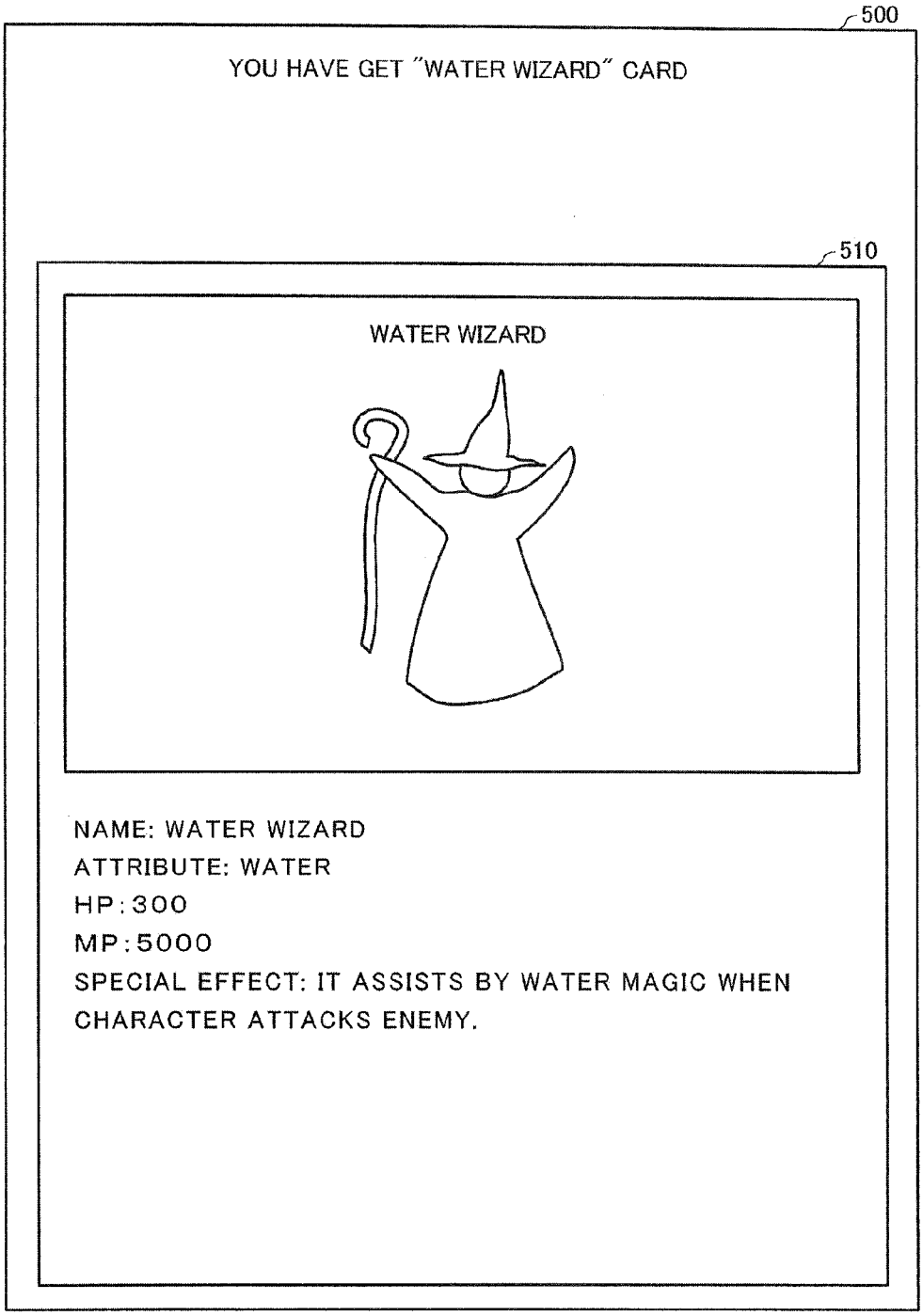
FIG. 6 is a diagram illustrating an example of a card acquisition image according to the first embodiment.

FIG. 6 is a diagram illustrating an example of a card acquisition image 500 according to the first embodiment. The card acquisition image 500 includes a card image 510 that indicates the acquired card. The card image 510 shows the name, the attribute, and the like of the card.

According to the first embodiment, the information generation device 100 can adjust the selection probability of the game medium based on the variable element parameter value, and can generate information for more effectively providing the game medium by generating indication information that indicates the adjusted selection probability of the game medium.

According to the first embodiment, since the information generation device 100 can execute the lottery event corresponding to the strength value (i.e., parameter value) of the character, and can make an adjustment based on the winning percentage (i.e., parameter value) of the player, the information generation device 100 can generate information for more effectively providing the game medium.

According to the first embodiment, since the information generation device 100 presents the indication information to the player, the player can easily determine whether to immediately play the lottery event or play the lottery event after the winning percentage has increased. This makes it possible to provide the game with improved strategic characteristics.

Second Embodiment

Figure 7:
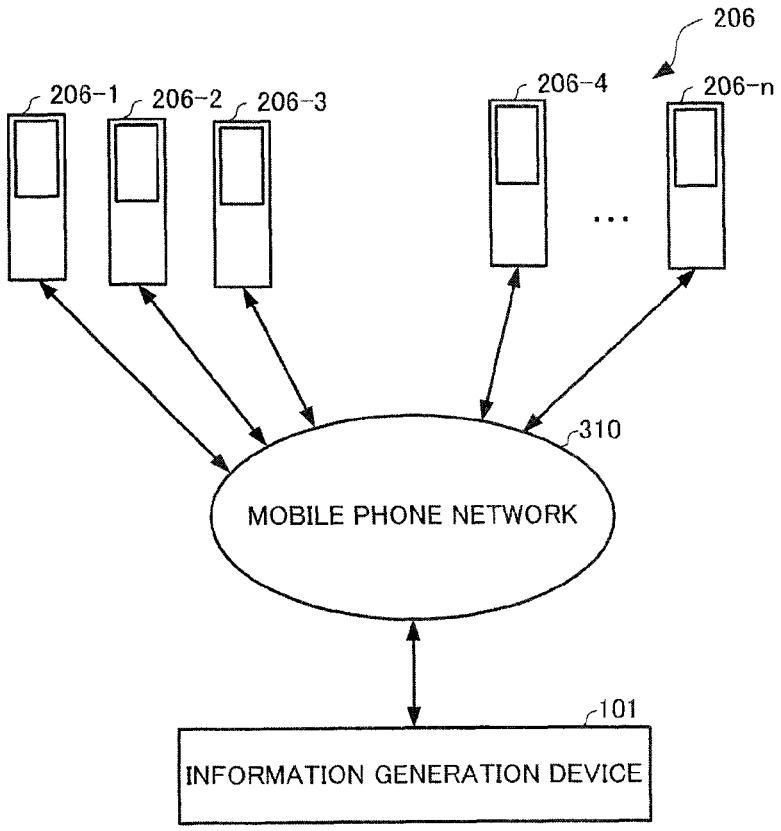
FIG. 7 is a diagram illustrating an information provision system according to a second embodiment of the invention.

FIG. 7 is a diagram illustrating an information provision system according to a second embodiment of the invention. The information provision system according to the second embodiment includes n mobile phones 206-1 to **206-*n*, and an information generation device 101. Each mobile phone 206 exchanges information with the information generation device 101 via a mobile phone network 310. The information provision system according to the second embodiment forms a social network, and the rare item selection probability is raised when a friend's game status satisfies a given condition. The functional blocks of the information generation device 101** having the above functions are described below.

Figure 8:
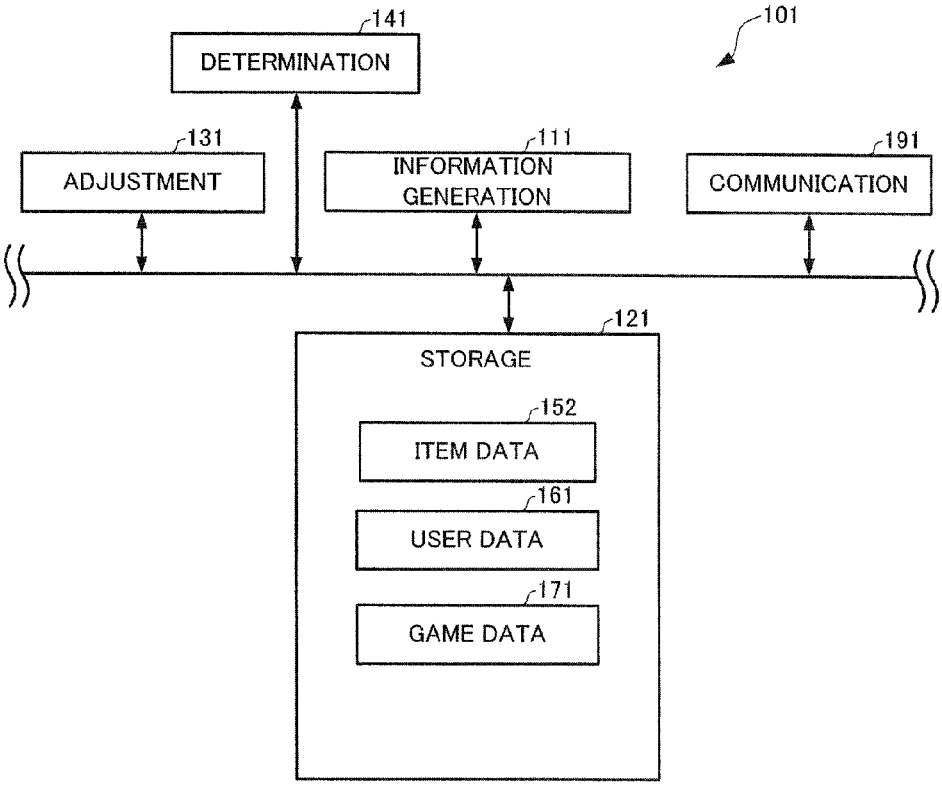
FIG. 8 is a diagram illustrating the functional blocks of an information generation device according to the second embodiment.

FIG. 8 is a diagram illustrating the functional blocks of the information generation device 101 according to the second embodiment. The information generation device 101 includes an information generation section 111 that generates image information and the like, a storage section 121, an adjustment section 131 that adjusts the selection probability, a determination section 141, and a communication section 191 that exchanges information with the mobile phone 206. The storage section 121 stores item data 152 that indicates the selection probability of each item, and the like, user data 161 that is similar to the user data 160, game data 171 that is similar to the game data 170, and the like. The functional blocks of the mobile phone 206, and the hardware configurations of the information generation device 101 and the mobile phone 206 are the same as those described above in connection with the first embodiment. Therefore, description thereof is omitted.

Figure 9:
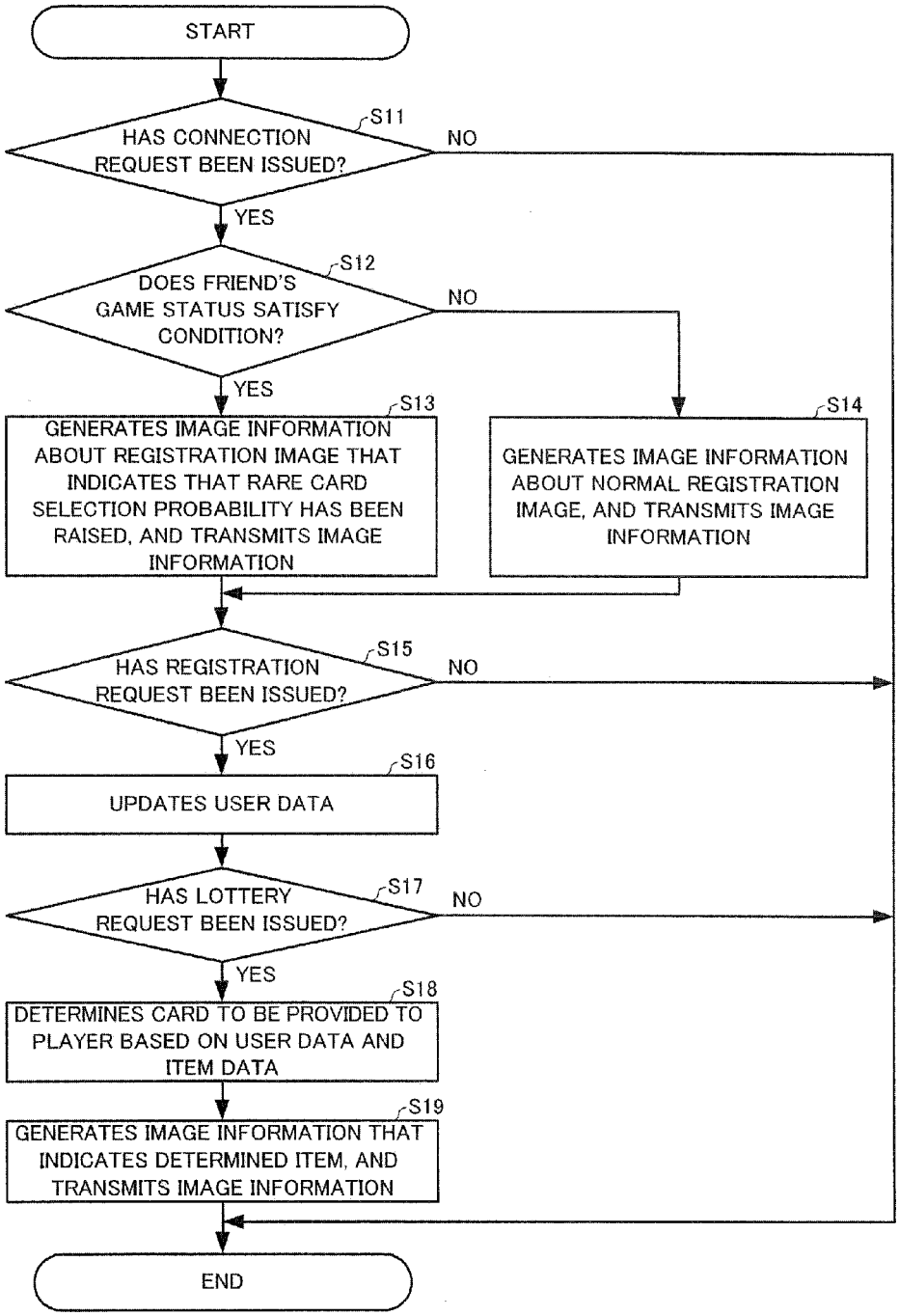
FIG. 9 is a flowchart illustrating a process performed by the information generation device according to the second embodiment.

A process from issuance of a connection request to provision of an item image is described below. FIG. 9 is a flowchart illustrating the process performed by the information generation device 101 according to the second embodiment. The player who operates the mobile phone 206-1 issues a connection request by operating the mobile phone 206-1. The determination section 141 determines whether or not the connection request has been issued based on information from the communication section 191 (step S11).

When the determination section 141 has determined that the connection request has been issued, the determination section 141 determines based on the user data 161 whether or not the game status of another player (first player (one or a plurality of players) who is a friend of the player who operates the mobile phone 206-1 (second player) satisfies a condition (e.g., the highest score of at least one first player in the game makes the top 100) whereby the rare item selection probability is raised (step S12).

When the determination section 141 has determined that the game status of the friend satisfies the above condition, the information generation section 111 generates image information about a registration image that indicates that the rare card selection probability has been raised, and the communication section 191 transmits the image information to the mobile phone 206-1 (step S13).

When the determination section 140 has determined that the game status of the friend does not satisfy the above condition, the information generation section 111 generates image information about a normal registration image, and the communication section 191 transmits the image information to the mobile phone 206-1 (step S14).

Figure 10:
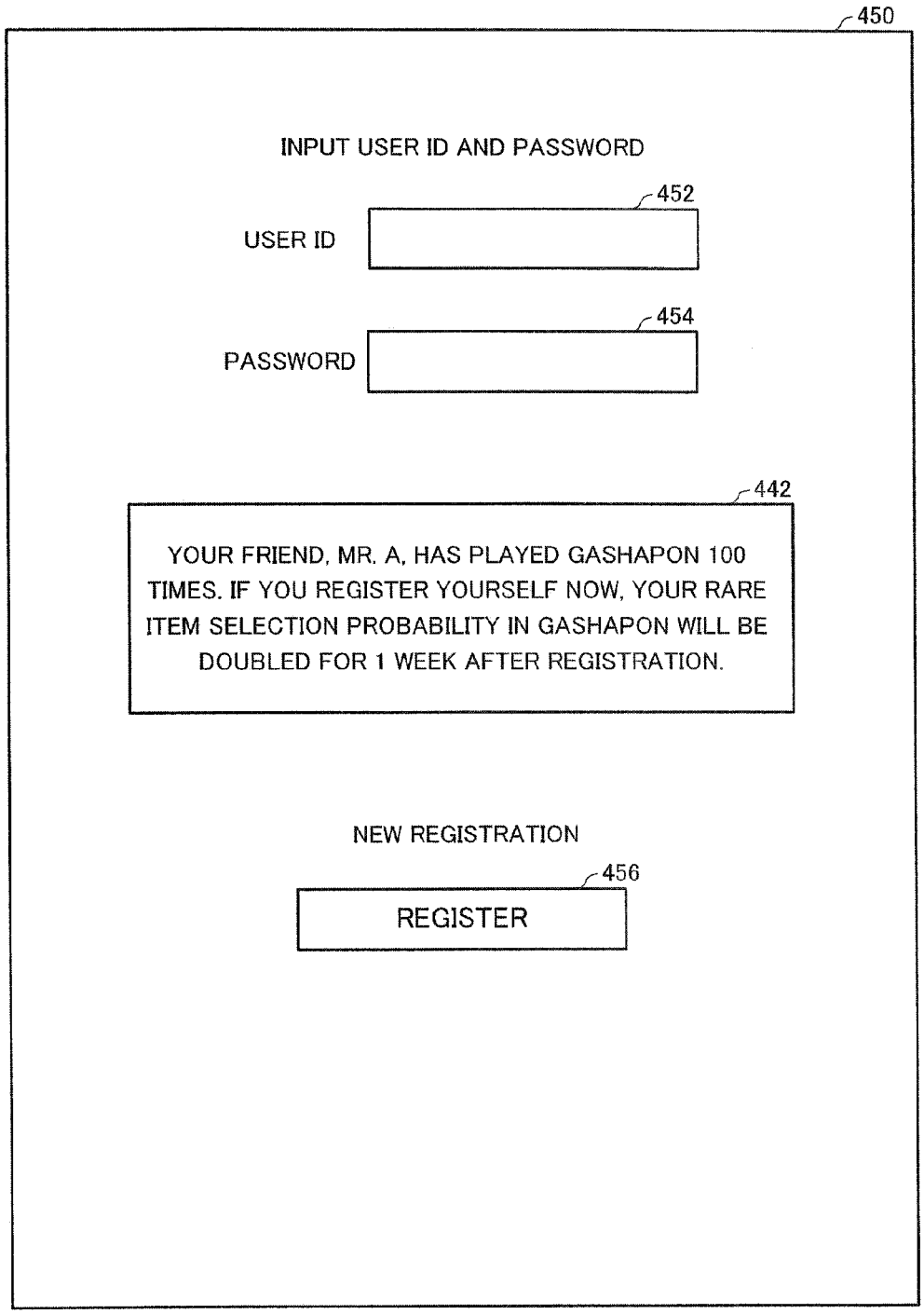
FIG. 10 is a diagram illustrating an example of a registration image according to the second embodiment.

The mobile phone 206-1 displays the registration image based on the image information. FIG. 10 is a diagram illustrating an example of a registration image 450 according to the second embodiment. The registration image 450 that indicates that the selection probability has been raised, includes an entry field 452 for inputting a user ID, an entry field 454 for inputting a password, an indication image 442 that indicates that the rare item selection probability will be doubled since the game status of the friend satisfies a given condition, a registration image 456, and the like. The registration image 450 that is generated when the above condition is not satisfied does not include the indication image 442.

The player issues a registration request by selecting the registration image 456. The determination section 141 determines whether or not the communication section 191 has received operation information that indicates the registration request from the mobile phone 206-1 to determine whether or not the registration request has been issued (step S15). When the determination section 141 has determined that the registration request has been issued, the adjustment section 131 updates the user data 161, based on the user data 161, to adjust the rare item selection probability (step S16). For example, the adjustment section 131 writes the registration date/time into the user data 161, sets a flag that indicates that the rare item selection probability is doubled for 1 week after registration to ON, and sets the flag to OFF when 1 week has elapsed after registration.

The player issues a lottery request by performing a lottery selection operation. The determination section 141 determines whether or not the communication section 191 has received operation information that indicates the lottery request from the mobile phone 206-1 to determine whether or not the lottery request has been issued (step S17). When the determination section 141 has determined that the lottery request has been issued, the determination section 141 determines an item to be provided to the player based on the user data 161 and the item data 152 (step S18). For example, when the flag is set to ON, the determination section 141 determines an item to be provided to the player in a state in which the rare item selection probability is doubled.

The information generation section 111 generates image information that indicates the item determined by the determination section 141 based on the item data 152, and the communication section 191 transmits the image information to the mobile phone 206-1. The mobile phone 206-1 displays an image that indicates the acquired item based on the image information.

The information generation device 101 according to the second embodiment thus achieves the same advantageous effects as those achieved by the first embodiment. According to the second embodiment, the first player and the second player can be linked in an improved way by adjusting the selection probability of the game medium for the second player based on the game status of the first player.

Third Embodiment

Figure 11:
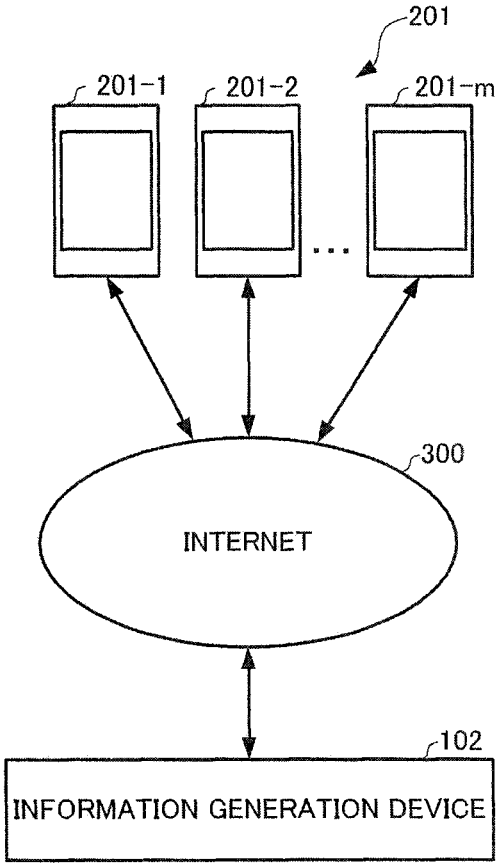
FIG. 11 is a diagram illustrating an information provision system according to a third embodiment of the invention.

FIG. 11 is a diagram illustrating an information provision system according to a third embodiment of the invention. The information provision system according to the third embodiment includes m smartphones 201-1 to **201-*m*, and an information generation device 102. Each smartphone 201 exchanges information with the information generation device 102 via an Internet 300. In the third embodiment, a character (image) is provided in the lottery event, and the rare character selection probability in the lottery event is raised when the history of the lottery event satisfies a given condition. The functional blocks of the information generation device 102** having the above functions are described below.

Figure 12:
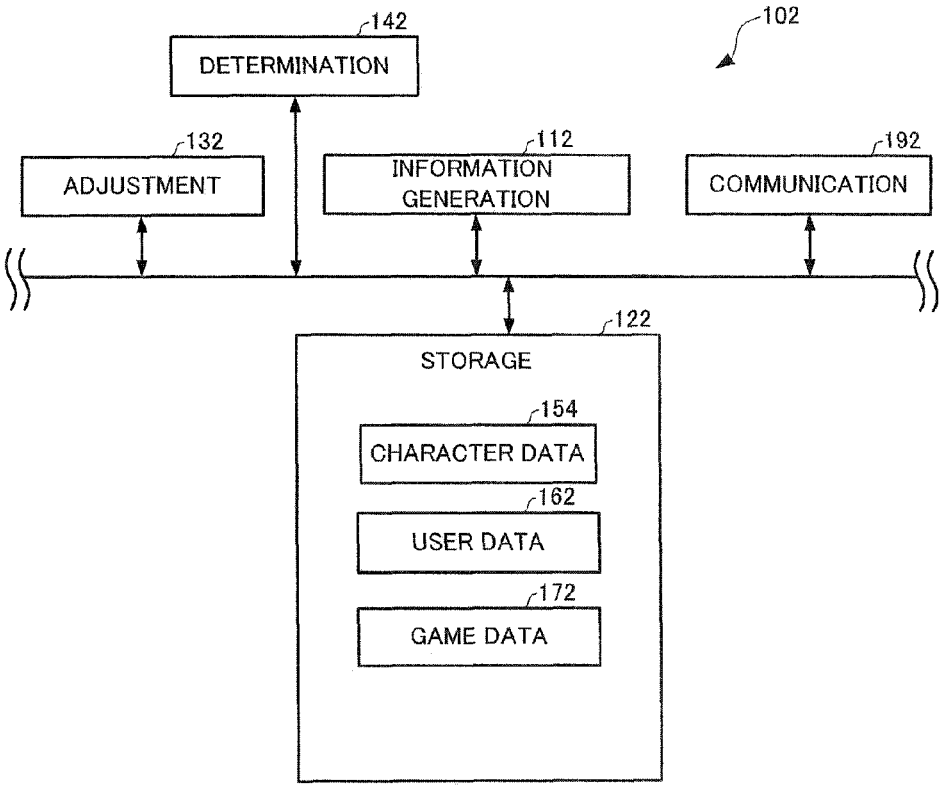
FIG. 12 is a diagram illustrating the functional blocks of an information generation device according to the third embodiment.

FIG. 12 is a diagram illustrating the functional blocks of the information generation device 102 according to the third embodiment. The information generation device 102 includes an information generation section 112 that generates image information and the like, a storage section 122, an adjustment section 132 that adjusts the selection probability, a determination section 142, and a communication section 192 that exchanges information with the smartphone 201. The storage section 122 stores character data 154 that indicates the selection probability of each character, and the like, user data 162 that is similar to the user data 160, game data 172 that is similar to the game data 170, and the like. The functional blocks of the smartphone 201, and the hardware configurations of the information generation device 102 and the smartphone 201 are the same as those described above in connection with the first embodiment. Therefore, description thereof is omitted.

Figure 13:
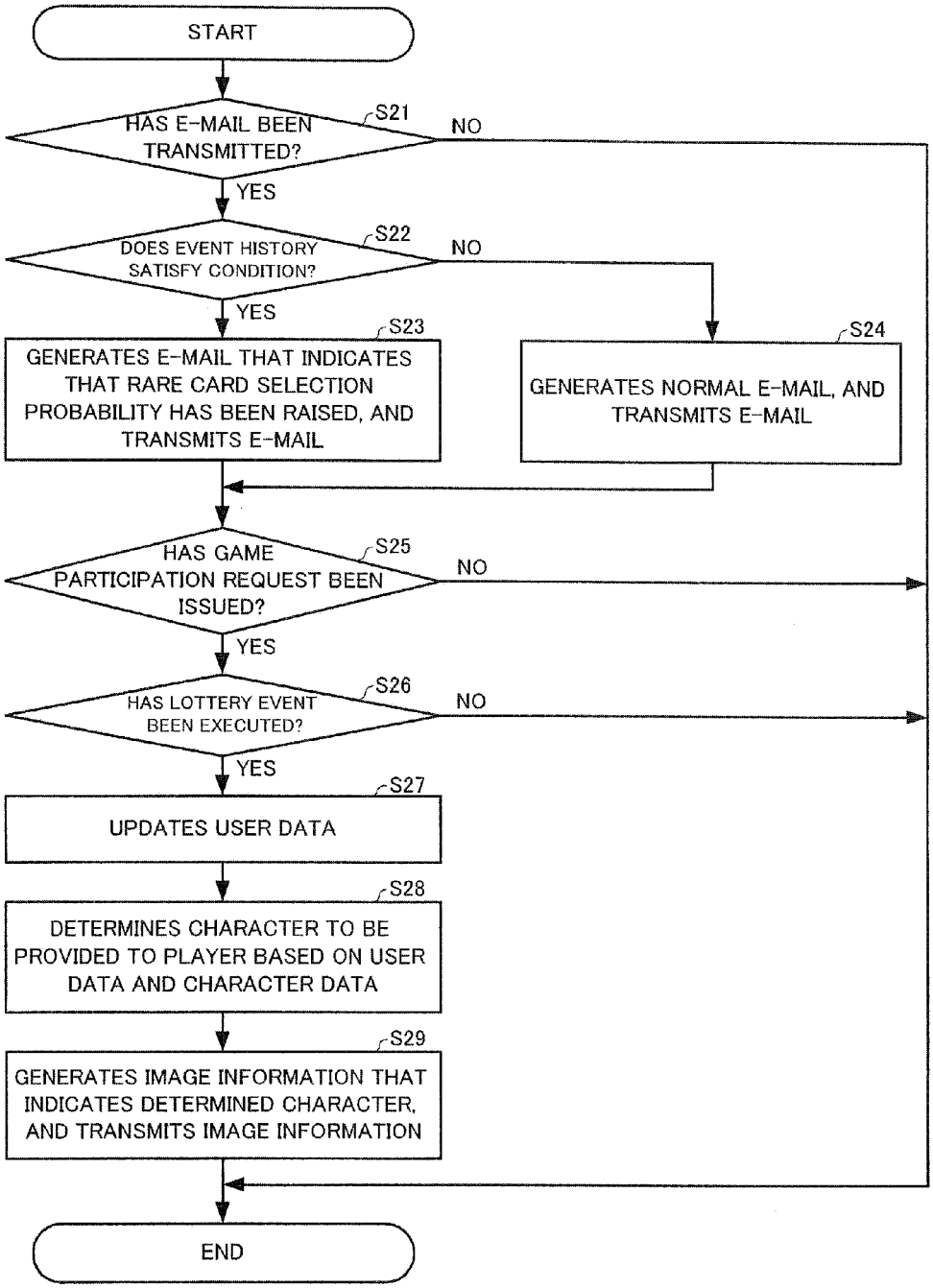
FIG. 13 is a flowchart illustrating a process performed by the information generation device according to the third embodiment.

A process from e-mail transmission to provision of a character image is described below. FIG. 13 is a flowchart illustrating the process performed by the information generation device 102 according to the third embodiment. The determination section 142 determines whether or not an event that transmits an e-mail to a specific player has been executed based on the user data 162 (step S21). When the determination section 142 has determined that the event has been executed, the determination section 142 determines based on the user data 162 whether or not the history (e.g., lottery count) of the lottery event in which the player is involved satisfies a condition whereby the rare character selection probability is raised (step S22).

When the determination section 142 has determined that the history of the lottery event satisfies the above condition, the information generation section 112 generates an e-mail that indicates that the rare character selection probability has been raised, and the communication section 192 transmits the e-mail to the smartphone 201-1 (step S23).

When the determination section 142 has determined that the history of the lottery event does not satisfy the above condition, the information generation section 112 generates a normal e-mail, and the communication section 192 transmits the e-mail to the smartphone 201-1 (step S24).

The smartphone 201-1 displays an e-mail image that indicates the e-mail. FIG. 14 is a diagram illustrating an example of an e-mail image 600 according to the third embodiment. For example, the e-mail image 600 when the above condition is satisfied, includes an image that indicates that the rare character selection probability is tripled (e.g. "CONGRATULATIONS ON 500TH LOTTERY! RARE CHARACTER SELECTION PROBABILITY IS TRIPLED FROM 14:00 TO 18:00 TOMORROW."). The e-mail image 600 that is generated when the above condition is not satisfied does not include such an image.

The determination section 142 determines whether or not the player has issued a game participation request based on information from the communication section 192 (step S25). When the determination section 142 has determined that the player has issued the game participation request, the determination section 142 determines whether or not the lottery event has been executed in the game (step S26). The adjustment section 132 updates a value or the like that is stored as the user data 162 and indicates the number of times that the lottery event has been executed, when the lottery event has been executed in the game (step S27). For example, the adjustment section 132 updates the user data 162 (e.g., updates the flag) so that the rare character selection probability is tripled when the number of times that the lottery event has been executed is 500 or more, and the game is executed on the designated date/time, and returns the rare character selection probability stored as the user data 162 to the original value when the designated date/time has passed/elapsed.

When the determination section 142 has determined that the lottery event has been executed, the determination section 142 determines a character to be provided to the player based on the user data 162 and the character data 154 (step S28). For example, the determination section 142 determines a character to be provided to the player in a state in which the rare character selection probability indicated by the character data 154 is tripled, when the flag that triples the rare character selection probability stored as the user data 162 is set to ON.

The information generation section 112 generates image information that indicates the character determined by the determination section 142 based on the character data 154, and the communication section 192 transmits the image information to the smartphone 201-1. The smartphone 201-1 displays an image that indicates the provided character based on the image information.

The information generation device 102 according to the third embodiment thus achieves the same advantageous effects as those achieved by the first embodiment. According to the third embodiment, it is possible to prompt the player to play the lottery event by adjusting the selection probability corresponding to the number of times that the lottery event has been executed.

Additional Embodiments

The invention is not limited to the above embodiments. Various modifications and variations may be made of the above embodiments. For example, the variable element parameter value is not indispensable in the first embodiment. The information generation device according to the first embodiment may include a determination section that determines whether or not the lottery event can be executed based on an execution parameter value for executing the lottery event for providing the game medium, and an information generation section that generates information that indicates that the lottery event can be executed when the determination section has determined that the lottery event can be executed.

The above configuration also makes it possible for the information generation device to indicate that the lottery event can be executed.

The variable element parameter value and the execution parameter value used in the first embodiment may be identical. For example, when the variable element parameter value and the execution parameter value are a strength value, the information generation device may execute the lottery event when the strength value is 50% or more, and may raise the rare card selection probability as the strength value increases.

The first embodiment has been described above taking an example in which the strength value of the character operated by the player is decreased by 10% when the lottery event for providing the card has been executed. Note that the strength value may be decreased when the character has been damaged (e.g., when the character has been attacked by the enemy, or when the character has come in contact with an obstacle), and may be increased when the character has recovered (e.g., when a given time has elapsed, or when a recovery item has been used). For example, the strength value may be recovered only up to a given limit value (e.g., 100%) when a given time has elapsed, but may be recovered to a value (e.g., 200%) that exceeds the given limit value when a recovery item has been used based on an operation performed by the player. According to the above configuration, the information generation device can change the rare card selection probability independently of an operation performed by the player, and can further raise the rare card selection probability when the player has performed a specific operation. This makes it possible to provide the game with improved strategic characteristics.

In this case, the selection probability of a rare card A may be set as described below. For example, the selection probability may be 1% when the strength value is 50%, may be 5% when the strength value is 100%, may be 10% when the strength value is 200%, and may be 20% when the strength value is 300%. A decrease in the strength value due to execution of the lottery event may be increased each time the rare card selection probability has increased. For example, the decrease in the strength value may be 50% when the rare card selection probability is 1%, and may be 80% when the rare card selection probability is 20%. When the strength value has exceeded the limit value, the strength value may be decreased to the limit value with the passage of time.

In the above embodiments, the parameter value may be a parameter value that relates to a character or the like (i.e., operation target or non-operation target) that appears in the game, a parameter value (e.g., at least one of the ability value of the operation target of the player, the attribute value of the operation target, the game result value of the operation target, the number of times that the lottery event can be played by the player, and the like) that relates to the player (human player or computer player), a game money (e.g., cash, electronic money, or game coin) paid by the player, the game money possessed by the player, or the like.

The first embodiment has been described above taking an example in which the adjustment section determines the data to be applied to the player from a plurality of types of data corresponding to the winning percentage, and adjusts the selection probability to reduce the amount of calculation process and the like. Note that the selection probability may be adjusted by a method other than a method that changes the game medium data. For example, the selection probability may be adjusted by a method that multiplies the default selection probability by a coefficient corresponding to a valid flag, a method that provides a plurality of functions, and changes the function applied to calculation of the selection probability, or the like.

In the second embodiment, the adjustment section may adjust the selection probability of the rare game medium provided to the second player on condition that the first player and the second player have a given positional relationship (e.g., the first player and the second player are positioned within a radius of 10 m, the first player and the second player are positioned within an identical town, the first player and the second player are positioned within an identical building, the first player and the second player are positioned in different towns, or the second player is positioned on the west with respect to the first player). According to the above configuration, since the information generation device can adjust the selection probability corresponding to the positional relationship between the players, it is possible to prompt the players to have a given positional relationship.

In the second embodiment, the number of first players may be two or more, and the adjustment section may increase the selection probability of the rare game medium provided to the second player as the number of first players who satisfy the selection probability adjustment condition increases. It is possible to prompt the second player to increase the number of first players by increasing the selection probability of the rare game medium provided to the second player as the number of first players increases.

In the second embodiment, the adjustment section may adjust the selection probability of the rare game medium provided to the second player corresponding to the attribute (e.g., address, age, sex, occupation, or possessed item) of the first player who satisfies the selection probability adjustment condition. When the information generation device can adjust the selection probability corresponding to the attribute of the first player, the information generation device can generate information for more effectively providing the game medium. For example, when the first player and the second player differ in sex, the adjustment section may increase the selection probability of the rare item as compared with the case where the first player and the second player are of the same sex.

The condition used in the second embodiment is not limited to a condition whereby the highest score of the friend in the game makes the top 100. The condition may be at least one condition among a condition whereby the friend participates in the game network, a condition whereby the game history of the friend satisfies a given condition, and a condition whereby the history of the lottery event of the first player satisfies a given condition.

In the second embodiment, the first player and the second player need not necessarily be friends. For example, the first player and the second player may be family members, schoolmates, colleagues, residents in the same region, or the like.

In the third embodiment, the number of times that the lottery event has been executed may not necessarily be used. For example, at least one of the number of times that the lottery event has been executed, the order in which the lottery event has been executed, the date/time at which the lottery event has been executed, and the provision history of the game medium upon execution of the lottery event. For example, the adjustment section may increase the selection probability when the second lottery event has been executed within 5 minutes after the first lottery event has been executed.

In the third embodiment, the user data 162 may include user-specific data (e.g., birthday), and the adjustment section may increase the selection probability when the date/time at which the lottery event has been executed coincides with the user-specific data (e.g., when the date at which the lottery event has been executed coincides with the birthday).

In the third embodiment, a plurality of types (e.g., event A, event B, and event C) of character data 154 may be set to differ in rare character selection probability, and the adjustment section may increase the selection probability when the events have been executed in a specific order (e.g., event A→event B→event C, or event C→event B→event A).

The execution state of the lottery event may be a provision history of the game medium upon execution of the lottery event, the adjustment section may increase the selection probability of the game medium that has not been provided as compared with the selection probability of the game medium that has been provided, or increases the selection probability of the game medium that has been provided with a lower probability or in a smaller number as compared with another game medium, and the information generation section may generate the indication information that indicates that the selection probability of the game medium for which the selection probability has been raised. For example, when the provision rate of a card having an attribute of fire is lower than that of a card having another attribute, or when a card having an attribute of fire has been provided in a smaller number as compared with a card having another attribute, or when a card having an attribute of fire has not been provided, the adjustment section may set a flag stored in the user data that doubles the selection probability of the card having an attribute of fire to ON, and the determination section may determined a card to be provided to the player in a state in which the selection probability of the card having an attribute of fire is doubled based on the flag. It is possible to prompt the player to play the lottery event by generating the indication information that indicates that the selection probability of the game medium that has not been provided, or has been provided with a lower probability or in a smaller number, has been raised, and generate information for more effectively providing the game medium.

The features described in connection with the above embodiments may be appropriately combined. In the second embodiment, the information generation section may generate an e-mail as the indication information, and the mobile phone 206 may generate and display an image that indicates the e-mail in the same manner as in the third embodiment. The indication information is not limited to image information, but may be sound information, control information (e.g., information that controls vibrations, light, or fragrance), or the like.

The indication method is not limited to a direct method (e.g., a method that displays a message "selection probability has been tripled"), but may be indirect method (e.g., emphasis or change). In the first embodiment, the information generation section may generate image information that displays the name of the lottery event as "NORMAL-GASHAPON" when the winning percentage is less than 60%, and data for which the selection probability of the rare card is low is used, and may generate image information that displays the name of the lottery event as "RARE-GASHAPON" when the winning percentage is 60%, and data for which the selection probability of the rare card is normal is used, and may generate image information that displays the name of the lottery event as "ULTRA RARE-GASHAPON" when the winning percentage is 100%, and data for which the selection probability of the rare card is high is used, for example. Alternatively, the information generation section may generate image information that blinks or enlarges the system image 410 illustrated in FIG. 5, or adds a star image, for example. According to the above configuration, the information generation device can visually notify the player that data for which the selection probability of the rare card is changed has been applied, for example.

In each embodiment, the adjustment section may maintain the selection probability of the game medium until the lottery event has been executed in a given number of times, or a given time has elapsed, after the adjustment section has adjusted the selection probability, and may return the selection probability to the value before the adjustment section has adjusted the selection probability when the lottery event has been executed in a given number of times, or a given time has elapsed.

It is possible to make a moderate adjustment by thus returning the selection probability to a value before the adjustment. Therefore, it is possible to generate information for more effectively providing a game medium.

The game medium used in each embodiment is not limited to a card, an item, and a character, but may be a coin, a vehicle (e.g., racing car), a character that forms a team, or the like. The indication information used in each embodiment is not limited to image information, but may be sound information, control information (e.g., information that controls vibrations, light, or fragrance), or the like. Specifically, the indication method is not limited to the method used in each embodiment, but may be a method that indicates the selection probability using a numerical value, a method that provides a highlight when the selection probability has been raised, or the like.

The lottery event is not limited to a lottery such as that of GASHAPON (registered trademark). The lottery event may be distribution of a card in a card game, determination of a member of a team in a soccer game, determination of a racing car in a racing game, determination of a weapon that can be used by a character, or the like.

When the variable element parameter value used in each embodiment is a parameter value of the operation target of the player, the parameter value may be at least one value among the ability value (e.g., strength value, level, attack capability, defense capability, or magic capability) of the operation target, the attribute value (e.g., possessed item, address, age, sex, occupation, or type) of the operation target, and the game result value (e.g., number of consecutive wins, number of consecutive losses, total number of wins, total number of losses, score, time, or event clear) of the operation target.

In each embodiment, the adjustment section may adjust the selection probability so that the selection probability is higher than 0% and lower than 100%, and is higher than the selection probability before the adjustment. According to the above configuration, the information generation device can appropriately provide a rare game medium.

In each embodiment, the terminal is not limited to the smartphone 200 or 201 and the mobile phone 206, but may be a game device, a personal computer (PC), or the like. The operation performed using the terminal is not limited to a button operation and a touch operation, but may be a voice input operation or the like.

In each embodiment, the information generation device may transmit the indication information to the terminal at regular intervals even when request information has not been received from the terminal, for example.

The configuration of the information generation device and the configuration of the information provision system are not limited to those described above in connection with each embodiment. For example, the terminal may have some of the functions of the information generation devices 100 to 102, or a game device may have some of the functions of the information generation devices 100 to 102, or at least one of two portable game devices that can communication with each other via a peer-to-peer network may have some of the functions of the information generation devices 100 to 102. The information generation device and the information provision system need not necessarily communicate with the terminal. The information generation device and the information provision system may be implemented by a game device, a PC, or the like that provides the indication information to the player by displaying the indication information on the screen, for example.

Although only some embodiments of the invention have been described in detail above, those skilled in the art would readily appreciate that many modifications are possible in the embodiments without materially departing from the novel teachings and advantages of the invention. Accordingly, such modifications are intended to be included within the scope of the invention.

The following are configuration examples according to the first embodiment of the invention.

(1) An information generation device including:

a determination section that determines whether or not a lottery event for providing a game medium can be executed based on an execution parameter value for executing the lottery event; and an information generation section that generates information that indicates that the lottery event can be executed when the determination section has determined that the lottery event can be executed.

(2) An information generation device including:

a determination section that determines whether or not a lottery event for providing a game medium that is displayed in a game can be executed based on an execution parameter value for executing the lottery event;

an adjustment section that adjusts a selection probability of the game medium based on a variable element parameter value that changes the selection probability of the game medium in the lottery event; and an information generation section that generates indication information corresponding to the selection probability adjusted by the adjustment section when the determination section has determined that the lottery event can be executed, the indication information indicating the selection probability of the game medium in the lottery event.

(3) The information generation device as defined in (2), wherein the adjustment section adjusts the selection probability of the game medium based on a parameter value that relates to a character in the game or a parameter value that relates to a player that is the variable element parameter value.

(4) The information generation device as defined in (2) or (3), further including:

a storage section that stores a plurality of types of game medium data that indicates the selection probability of the game medium, wherein the adjustment section adjusts the selection probability of the game medium by changing the game medium data to be used.

(5) The information generation device as defined in any one of (1) to (4), wherein the execution parameter value is a parameter value that relates to a character in the game or a parameter value that relates to a player.

(6) The information generation device as defined in (3) or (5), wherein the parameter value that relates to the player is at least one of an ability value of an operation target of the player, a attribute value of the operation target, a game result value of the operation target, and a number of times that the lottery event can be played by the player.

(7) The information generation device as defined in any one of (1) to (6), further comprising:

a communication section that transmits the indication information to a terminal that executes the game.

(8) An information provision system including:

the information generation device as defined in (7); and the terminal that executes the game.

(9) The information provision system as defined in (8), wherein the terminal includes an image generation section and a display section, the information generation section generates image information as the indication information, the image generation section generates an image that indicates the selection probability based on the image information transmitted from the information generation device, and the display section displays the image.

(10) An information provision system that provides information that indicates that a lottery event for providing a game medium can be executed, the information provision system including:

a determination section that determines whether or not the lottery event can be executed based on an execution parameter value for executing the lottery event; and an information generation section that generates information that indicates that the lottery event can be executed when the determination section has determined that the lottery event can be executed.

(11) An information provision system that provides indication information that indicates a selection probability of a game medium in a lottery event for providing the game medium, the game medium being displayed in a game, the information provision system including:

a determination section that determines whether or not the lottery event can be executed based on an execution parameter value for executing the lottery event;

an adjustment section that adjusts the selection probability of the game medium based on a variable element parameter value that changes the selection probability of the game medium in the lottery event; and an information generation section that generates the indication information corresponding to the selection probability adjusted by the adjustment section when the determination section has determined that the lottery event can be executed.

(12) A non-transitory information storage medium storing a program that causes a computer to function as:

a determination section that determines whether or not a lottery event for providing a game medium can be executed based on an execution parameter value for executing the lottery event; and an information generation section that generates information that indicates that the lottery event can be executed when the determination section has determined that the lottery event can be executed.

(13) A non-transitory information storage medium storing a program that causes a computer to function as:

a determination section that determines whether or not a lottery event for providing a game medium that is displayed in a game can be executed based on an execution parameter value for executing the lottery event;

an adjustment section that adjusts a selection probability of the game medium based on a variable element parameter value that changes the selection probability of the game medium in the lottery event; and an information generation section that generates indication information corresponding to the selection probability adjusted by the adjustment section when the determination section has determined that the lottery event can be executed, the indication information indicating the selection probability of the game medium in the lottery event.

The following are configuration examples according to the third embodiment of the invention.

(1) An information generation device comprising:

an adjustment section that adjusts a selection probability of a game medium that is displayed in a game based on an execution state of a lottery event for providing the game medium; and an information generation section that generates indication information corresponding to the selection probability adjusted by the adjustment section, the indication information indicating the selection probability of the game medium in the lottery event.

(2) The information generation device as defined in (1), wherein the execution state of the lottery event is at least one of the number of times that the lottery event has been executed, an order in which the lottery event has been executed, a date/time at which the lottery event has been executed, and a provision history of the game medium upon execution of the lottery event.

(3) The information generation device as defined in (1), wherein the execution state of the lottery event is a provision history of the game medium upon execution of the lottery event, the adjustment section increases the selection probability of the game medium that has not been provided as compared with the selection probability of the game medium that has been provided, or increases the selection probability of the game medium that has been provided with a lower probability or in a smaller number as compared with another game medium, and the information generation section generates the indication information that indicates that the selection probability of the game medium for which the selection probability has been raised.

(4) The information generation device as defined in any one of (1) to (3), wherein the adjustment section maintains the selection probability of the game medium until the lottery event has been executed in a given number of times, or a given time has elapsed, after the adjustment section has adjusted the selection probability, and returns the selection probability to a value before the adjustment section has adjusted the selection probability when the lottery event has been executed in a given number of times, or a given time has elapsed.

(5) The information generation device as defined in any one of (1) to (4), further comprising:

a communication section that transmits the indication information to a terminal that executes the game.

(6) The information provision system including:

the information generation device as defined in (5); and the terminal that executes the game.

(7) The information provision system as defined in (6), wherein the terminal includes an image generation section and a display section, the information generation section generates image information as the indication information, the image generation section generates an image that indicates the selection probability based on the image information transmitted from the information generation device, and the display section displays the image.

(8) The information provision system as defined in (7), wherein the communication section transmits the image information to the terminal when the terminal has connected to a game network, or when the lottery event can be executed, or when the lottery event has been executed in the terminal.

(9) The information provision system as defined in (8), wherein the terminal includes an image generation section and a display section, the information generation section generates an e-mail as the indication information, the image generation section generates an image that indicates the selection probability based on the e-mail transmitted from the information generation device, and the display section displays the image.

(10) An information provision system that provides indication information that indicates a selection probability of a game medium in a lottery event for providing the game medium, the game medium being displayed in a game, the information provision system including:

an adjustment section that adjusts the selection probability based on an execution state of the lottery event; and an information generation section that generates the indication information corresponding to the selection probability adjusted by the adjustment section.

(11) A non-transitory information storage medium storing a program that causes a computer to function as:

an adjustment section that adjusts a selection probability of a game medium that is displayed in a game based on an execution state of a lottery event for providing the game medium; and an information generation section that generates indication information corresponding to the selection probability adjusted by the adjustment section, the indication information indicating the selection probability of the game medium in the lottery event.

What is claimed is:

1. An information generation device comprising:

a memory; and at least one processor configured to, based on executing instructions stored in the memory, generate, in an information generation section, first image information for a first game played by a first player based on operation information input by the first player, and second image information for a second game played by a second player based on operation information input by the second player, the second game is not the first game;

adjust, in an adjustment section, a selection probability of a game medium provided to the second player based on a game status of the first player, the game medium being displayed in the second game, the game medium being at least one of a game card, a game item, and a game character;

generate, in the information generation section, indication information corresponding to the selection probability adjusted by the adjustment section based on the game status of the first player, the indication information indicating the selection probability of the second player acquiring the game medium in a lottery event to the second player, the lottery event being an event for providing the game medium;

determine, in a determination section, the game medium to be provided to the second player upon execution of the lottery event, based on the selection probability adjusted by the adjustment section based on the game status of the first player; and transmit, to the second game played by the second player, upon receipt of a lottery request, the game medium determined by the determination section based on the selection probability adjusted by the adjustment section based on the game status of the first player.

2. The information generation device as defined in claim 1, wherein the adjustment section adjusts the selection probability of the game medium provided to the second player based on at least one condition among a condition whereby the first player is playing the first game, a condition whereby the first player is participating in a network of the first game, a condition whereby a history of the first game played by the first player satisfies a given condition, and a condition whereby a history of the lottery event played by the first player satisfies a given condition.

3. The information generation device as defined in claim 1, wherein the adjustment section adjusts the selection probability of the game medium provided to the second player on condition that the first player and the second player have a given relationship.

4. The information generation device as defined in claim 1, wherein the adjustment section adjusts the selection probability of the game medium provided to the second player on condition that the first player and the second player have a given positional relationship.

5. The information generation device as defined in claim 1, wherein a number of the first players is two or more, and the adjustment section increases the selection probability of the game medium provided to the second player as the number of the first players who satisfy a selection probability adjustment condition increases.

6. The information generation device as defined in claim 1, wherein the adjustment section adjusts the selection probability of the game medium provided to the second player corresponding to an attribute of the first player who satisfies a selection probability adjustment condition.

7. The information generation device as defined in claim 1, further comprising:

a communication section that transmits the indication information to a terminal that executes the second game.

8. The information generation device as defined in claim 7, wherein the communication section transmits the second image information to the terminal when the terminal has connected to a game network, or when the lottery event can be executed, or when the lottery event has been executed in the terminal.

9. An information provision system comprising:

the information generation device as defined in claim 7; and the terminal that executes the second game.

10. The information provision system as defined in claim 9, wherein the terminal includes an image generation section and a display section, the information generation section generates an e-mail as the indication information, the image generation section generates an image that indicates the selection probability based on the e-mail transmitted from the information generation device, and the display section displays the image.

11. The information provision system as defined in claim 9, wherein the terminal includes an image generation section and a display section, the information generation section generates the second image information as the indication information, the image generation section generates an image that indicates the selection probability based on the second image information transmitted from the information generation device, and the display section displays the image.

12. An information provision system that provides indication information that indicates a selection probability of a game medium that is displayed in a game, the information provision system comprising:

a memory; and at least one processor configured to, based on executing instructions stored in the memory, generate, in an information generation section, first image information for a first game played by a first player based on operation information input by the first player, and second image information for a second game played by a second player based on operation information input by the second player, the second game is not the first game;

adjust, in an adjustment section, the selection probability of the game medium provided to the second player based on a game status of the first player, the game medium being at least one of a game card, a game item, and a game character;

generate, in the information generation section, the indication information corresponding to the selection probability adjusted by the adjustment section based on the game status of the first player, the indication information indicating the selection probability of the second player acquiring the game medium in a lottery event to the second player, the lottery event being an event for providing the game medium;

determine, in a determination section, the game medium to be provided to the second player upon execution of the lottery event, based on the selection probability adjusted by the adjustment section based on the game status of the first player; and transmit, to the second game played by the second player, upon receipt of a lottery request, the game medium determined by the determination section based on the selection probability adjusted by the adjustment section based on the game status of the first player.

13. A non-transitory information storage medium storing thereon a program, which when executed by at least one processor, causes the at least one processor to:

generate, in an information generation section, first image information for a first game played by a first player based on operation information input by the first player, and second image information for a second game played by a second player based on operation information input by the second player, the second game is not the first game;

adjust, in an adjustment section, a selection probability of a game medium that is provided to the second player based on a game status of the first player, the game medium being displayed in the second game, the game medium being at least one of a game card, a game item, and a game character;

generate, in the information generation section, indication information corresponding to the selection probability adjusted by the adjustment section based on the game status of the first player, the indication information indicating the selection probability of the second player acquiring the game medium in a lottery event to the second player, the lottery event being an event for providing the game medium;

determine, in a determination section, the game medium to be provided to the second player upon execution of the lottery event, based on the selection probability adjusted by the adjustment section based on the game status of the first player; and transmit, to the second game played by the second player, upon receipt of a lottery request, the game medium determined by the determination section based on the selection probability adjusted by the adjustment section based on the game status of the first player.

14. The information generation device as defined in claim 1, further comprising a communication section that transmits image information to a terminal that executes the second game, wherein when it is determined that a connection request is issued by the terminal that executes the second game, the information generation section generates the second image information which includes the indication information that indicates the selection probability of the second player acquiring the game medium adjusted by the adjustment section based on the game status of the first player, and the communication transmits the second image information, to the terminal that executes the second game; and when it is determined that the lottery request is issued by the terminal that executes the second game, the information generation section further generates the second image information which includes the indication information that indicates the game medium determined by the determination section based on the selection probability adjusted by the adjustment section based on the game status of the first player, and the communication further transmits the second image information, to the terminal that executes the second game.

15. The information provision system as defined in claim 12, further comprising a communication section that transmits image information to a terminal that executes the second game, wherein when it is determined that a connection request is issued by the terminal that executes the second game, the information generation section generates the second image information which includes the indication information that indicates the selection probability of the second player acquiring the game medium adjusted by the adjustment section based on the game status of the first player, and the communication transmits the second image information, to the terminal that executes the second game; and when it is determined that the lottery request is issued by the terminal that executes the second game, the information generation section further generates the second image information which includes the indication information that indicates the game medium determined by the determination section based on the selection probability adjusted by the adjustment section based on the game status of the first player, and the communication further transmits the second image information, to the terminal that executes the second game.

16. The non-transitory information storage medium as defined in claim 13, further comprising a communication section that transmits image information to a terminal that executes the second game, wherein when it is determined that a connection request is issued by the terminal that executes the second game, the information generation section generates the second image information which includes the indication information that indicates the selection probability of the second player acquiring the game medium adjusted by the adjustment section based on the game status of the first player, and the communication transmits the second image information, to the terminal that executes the second game; and when it is determined that the lottery request is issued by the terminal that executes the second game, the information generation section further generates the second image information which includes the indication information that indicates the game medium determined by the determination section based on the selection probability adjusted by the adjustment section based on the game status of the first player, and the communication further transmits the second image information, to the terminal that executes the second game.

17. The information generation device as defined in claim 1, wherein the at least one processor controls acquisition of game mediums in a game network using a lottery executed by terminals in the game network.

18. The information provision system as defined in claim 12, wherein the at least one processor controls acquisition of game mediums in a game network using a lottery executed by terminals in the game network.

19. The non-transitory information storage medium as defined in claim 13, wherein the at least one processor controls acquisition of game mediums in a game network using a lottery executed by terminals in the game network.

* * * * *